US007341005B2

(12) United States Patent
Baggott

(10) Patent No.: US 7,341,005 B2
(45) Date of Patent: Mar. 11, 2008

(54) CONCESSION TRAY

(76) Inventor: David I. Baggott, 2330 Lincoln Ave., Ogden, UT (US) 84401

( * ) Notice: Subject to any disclaimer, the term of this patent is extended or adjusted under 35 U.S.C. 154(b) by 0 days.

(21) Appl. No.: 10/754,222

(22) Filed: Jan. 9, 2004

(65) Prior Publication Data

US 2005/0028707 A1 Feb. 10, 2005

Related U.S. Application Data

(60) Provisional application No. 60/493,501, filed on Aug. 8, 2003.

(51) Int. Cl.
*A47B 23/00* (2006.01)

(52) U.S. Cl. ..... 108/42; 108/152; 108/144; 297/163

(58) Field of Classification Search ..... 108/42, 108/44, 47, 152, 26; 297/163, 146, 135, 297/167, 173, 152, 248
See application file for complete search history.

(56) References Cited

U.S. PATENT DOCUMENTS

| | | | | |
|---|---|---|---|---|
| 333,853 | A | 1/1886 | Handy | |
| 1,809,866 | A * | 6/1931 | Riesche | 108/44 |
| 2,184,047 | A * | 12/1939 | King | 108/134 |
| 3,773,381 | A * | 11/1973 | Brennan | 297/167 |
| 4,466,659 | A | 8/1984 | Carpentier et al. | |
| 4,519,648 | A | 5/1985 | Jovanovic | |
| 4,548,326 | A | 10/1985 | Danna et al. | |
| 4,668,010 | A | 5/1987 | Fujiwara | |
| 5,046,433 | A * | 9/1991 | Kramer et al. | 108/44 |
| 5,118,063 | A | 6/1992 | Young, Sr. | |
| 5,140,914 | A * | 8/1992 | Bohbot et al. | 108/44 |
| 5,143,337 | A | 9/1992 | Tomayko, Jr. et al. | |
| 5,348,218 | A | 9/1994 | Haire et al. | |
| 5,480,058 | A | 1/1996 | Hutchins | |
| 5,709,429 | A * | 1/1998 | Bergin | 297/248 |
| 5,713,628 | A | 2/1998 | Lucatuorto | |
| 5,775,655 | A * | 7/1998 | Schmeets | 108/42 |
| 5,813,354 | A | 9/1998 | Scott | |
| 5,876,092 | A * | 3/1999 | An | 297/146 |
| 5,931,527 | A | 8/1999 | D'Onofrio et al. | |
| 5,947,033 | A | 9/1999 | Lombardo | |
| 5,954,394 | A | 9/1999 | Czyzewski | |
| 6,240,667 | B1 | 6/2001 | Harney et al. | |
| 6,279,800 | B1 | 8/2001 | Lee | |
| 6,279,992 | B1 | 8/2001 | Plocher et al. | |
| 6,283,042 | B1 * | 9/2001 | Wargo et al. | 108/26 |
| 6,290,063 | B1 | 9/2001 | Vogt et al. | |

(Continued)

OTHER PUBLICATIONS

Caddy Products, Inc. and Leading Edge Systems, "Product Line," Jan. 1, 2004, pp. 1-16.

*Primary Examiner*—Jose V. Chen
(74) *Attorney, Agent, or Firm*—Kirton & McConkie; David B. Tingey

(57) ABSTRACT

A concession tray for selectively supporting concessions in a substantially horizontal position relative to a stadium seat, thereby facilitating the comfort and enjoyment of a patron at a performance or event. A retaining flange is coupled to the concession tray and easily integrated with an existing stadium seat such that the concession tray may retain concessions in a fixed relationship with a stadium seat without requiring substantial modification of the stadium seat, if any. The concession tray may also incorporate advertising thereon to generate revenue for a specific performance venue.

16 Claims, 9 Drawing Sheets

U.S. PATENT DOCUMENTS 6,315,126 B1 11/2001 Cornelissen
6,409,137 B1 6/2002 Tran
6,457,772 B1 10/2002 Forston
6,494,533 B1 12/2002 Bohler
6,550,861 B1 * 4/2003 Williamson ..... 108/44
6,601,523 B2 * 8/2003 Jensen ..... 108/44
6,708,627 B1 * 3/2004 Wood ..... 108/42
6,761,398 B2 * 7/2004 Bentley et al. ..... 297/146
2001/0024056 A1 9/2001 Romea et al.

* cited by examiner

CONCESSION TRAY

RELATED APPLICATIONS

The present application claims priority to U.S. Provisional Patent Application No. 60/493,501 entitled, "Concession Tray," filed on Aug. 8, 2003 by David I. Baggott, incorporated herein in its entirety by reference.

BACKGROUND OF THE INVENTION

1. Field of the Invention

The present invention relates to a collapsible tray apparatus for supporting food and beverages and, more particularly, to a collapsible tray apparatus adapted for individual use in a stadium or arena.

2. Background

Patrons and spectators at sporting events, concerts and theaters are typically seated in multiple rows of seats arranged in an inclined or stepped-up stadium tier arrangement. Stadium seats typically comprise a seating portion and a backrest portion, each of which is supported laterally on either side by a seat standard having an armrest portion that may be shared between spectators. The seating portion may be pivotally attached to each seat standard to enable the seat portion to be stowed substantially adjacent the backrest portion when the stadium seat is not occupied. In between the rows or tiers are relatively narrow aisles that permit access to and from interiorly disposed stadium seats. Such aisles also provide space for a spectator's feet and legs when the spectator is seated.

Stadiums, theaters and arenas commonly provide concessions and encourage their patrons to purchase and enjoy such concessions during an event. Once purchased, however, a patron must take care to avoid spills or other mishaps that may occur as a result of the patron having to manually support or balance the concessions, or having to place the concessions in the aisle area near the patron's feet. As a result, a patron's attention is often diverted from the event to the care of the purchased concessions, thereby reducing the patron's enjoyment of the event.

This problem is exacerbated when a patron purchases more than one concession, or when the patron is a child. Indeed, although holding or balancing one concession may be uncomfortable for a patron, holding or balancing more than one concession is often impossible. Further, children may lack the coordination necessary to effectively hold or balance a purchased concession at all. The temperature of the concession may also make manual retention of the concession difficult or impossible.

Various food and beverage holders have been developed to reduce the problems described above. Most such holders, however, fail to provide surface area adequate to support more than one concession, and often require modification of stadium seats for proper implementation and use. As most stadiums, theaters and arenas house thousands of stadium seats, the costs associated with seat modification often preclude implementation of concession trays requiring such. Portable holders that do not require modification of stadium seats are often unstable and prone to unattachment upon repeated jostling and jarring, as commonly experienced at concerts, sporting events and other performances.

Accordingly, what is needed is a concession tray capable of easy implementation in connection with existing seats in a stadium, theater or arena. What is also needed is a concession tray that may be securely fastened to a stadium seat, and where such security is not compromised by untoward movement caused by patrons finding their seats or physically expressing their excitement, enjoyment or frustration relating to the event at hand. Finally what is needed is a concession tray capable of providing a source of revenue for the stadium, theater or arena in which it is implemented by incorporating advertising on or in connection with the tray.

Such methods are disclosed and claimed herein.

SUMMARY OF THE INVENTION

The present invention is a concession tray for selectively supporting a plurality of concessions in a substantially horizontal position relative to a stadium seat, thereby facilitating the comfort and enjoyment of a patron at a performance or event. The concession tray may be pivotally articulated between a substantially vertical stowed position and a substantially horizontal use position via pivotal articulation means integral to either side of the concession tray. A retaining flange is coupled to each of the pivotal articulation means and also to a stabilizing portion of the stadium seat to enable retention of the concession tray in a substantially fixed position relative to a backrest of the stadium seat without requiring modification of the stadium seat. The concession tray may incorporate advertising thereon as a means to generate revenue for the stadium, theater or arena in which it resides. In this manner, a concession tray in accordance with the present invention may be easily and inexpensively implemented in a performance venue, and may also be used to generate revenue therefor.

An object of the present invention is to provide a concession tray capable of easy implementation in connection with existing seats in a stadium, theater or arena.

Another object of the present invention is to provide a concession tray that may be securely fastened to a stadium seat, and where such security is not compromised by untoward movement caused by patrons finding their seats or physically expressing their excitement, enjoyment or frustration relating to the event at hand.

A further object of the present invention is to provide a concession tray capable of providing a source of revenue for the stadium, theater or arena in which it is implemented by incorporating advertising on or in connection with the tray.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

As used in this specification, the term "stadium" refers to a stadium, theater, arena or other performance venue having seating accommodations for a plurality of spectators or patrons. The term "stadium seat" or "seat" refers to a structure capable of supporting the weight of a patron or spectator in an indoor or outdoor stadium, theater, arena, or other performance venue. The term "concession tray" or "tray" refers to a substantially planar structure for supporting food, beverages, and/or other concessions or lightweight items.

Figure 1A:
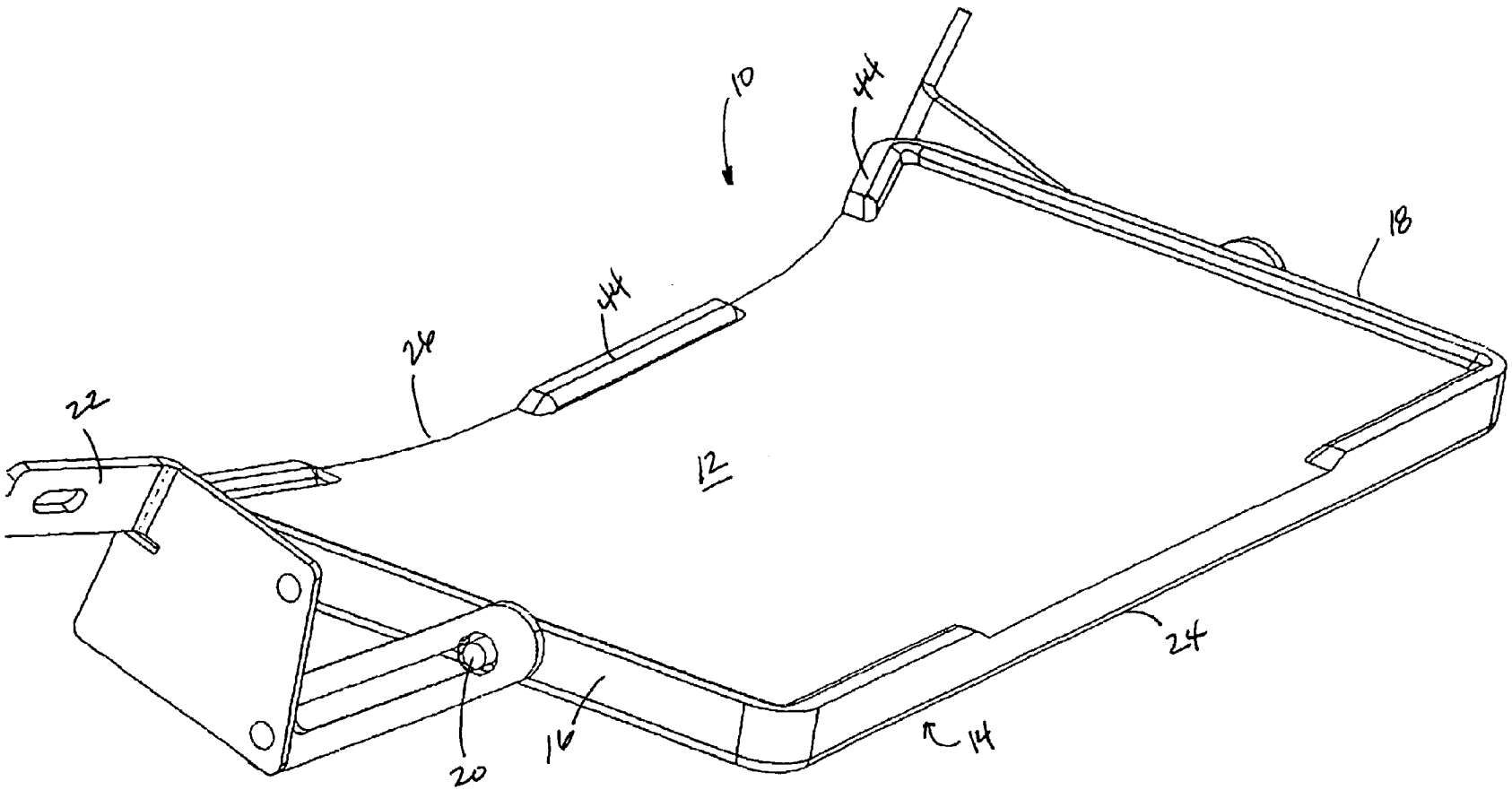
FIG. 1A is a perspective view of a concession tray in accordance with the present invention.
Figure 1B:
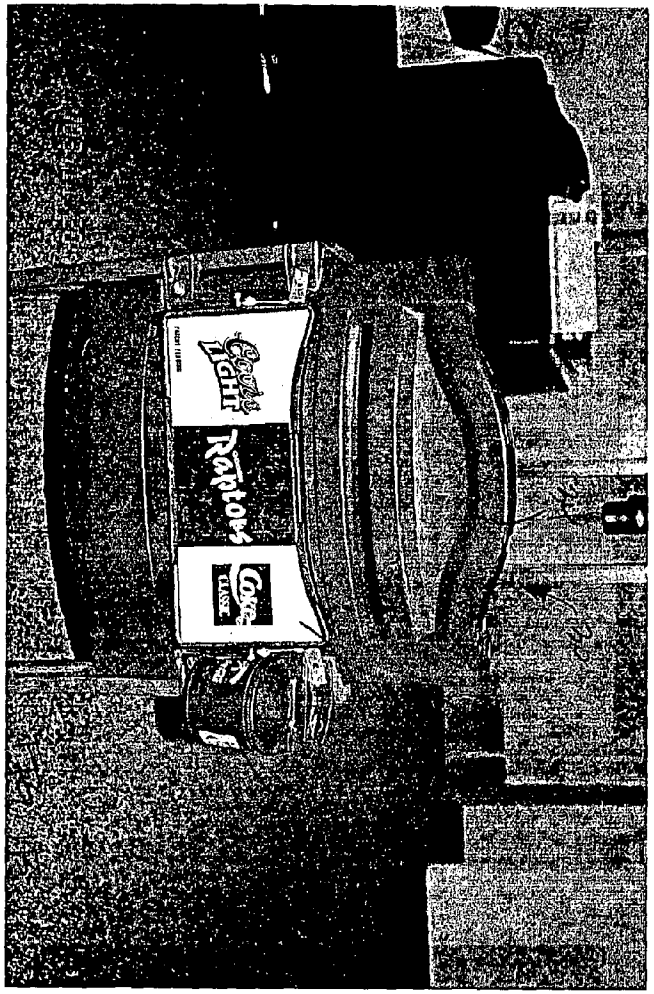
FIG. 1B is a perspective view of a concession tray incorporating advertising in accordance with certain embodiments of the present invention.

Referring to FIGS. 1A and 1B, a concession tray in accordance with the present invention may comprise a substantially planar supporting surface 12 for supporting food, beverages and/or other concessions. A concession tray 10 may further comprise a back surface 14 opposite the supporting surface 12 and parallel thereto, wherein a perpendicularly disposed lateral surface separates the supporting surface 12 from the back surface 14. A concession tray 10 may comprise metal, plastic, synthetic polymer, composite or a natural substance such as wood, other organic fiber, or any other suitable material formed to create a substantially planar supporting surface 12 for food, beverages and/or other concessions. A concession tray 10 may incorporate advertising on or in connection with its supporting and/or back surfaces 12 and 14, as seen in FIG. 1B, such that the advertising may be visible when the tray 10 is in use and/or when the tray is collapsed. Such advertising may comprise print advertisements, electronic advertisements, or advertisements in any other form known to those in the art. Advertising may comprise laminate applied to the supporting and/or back surface 12 or 14 of the concession tray 10, print integrated into one or more surfaces of the concession tray 10, paper or electronic advertisements inserted behind a transparent portion of a surface of the concession tray 10, or any other means of advertising known to those in the art. Alternatively, advertisements may be applied or integrated into a backrest portion 34 of a stadium seat 30, a beverage holder 70, or any other location conducive to spectator viewing.

According to certain embodiments of the present invention, a substantially planar supporting surface 12 may comprise a substantially rectangular shape having a distal edge 26 configured to complement the shape of a backrest portion 34 of a stadium seat 30. In one embodiment, a distal edge 26 curves inwardly to accommodate an outward curvature of a stadium seat backrest 34. A proximal edge 24 of the supporting surface 12 may curve inwardly to accommodate a spectator's body. Alternatively, a proximal edge 24 may maintain a straight profile or bow outwardly to maximize a surface area of the supporting surface 12. Alternatively, a supporting surface 12 may be configured to resemble any shape having any dimensions known to those in the art by which to accommodate concessions and/or spectators. A supporting surface 12 may further incorporate an elevated lip 44 around at least a portion of its outer perimeter to facilitate retention of items thereon. A lip 44 may comprise metal, wood, fiberglass, polymer, composite, or any other material known to those in the art capable of retaining concessions on the supporting surface 12 of a concession tray 10 in accordance with the present invention. Preferably, a lip 44 comprises the same material as the concession tray 10 on which it is implemented, and comprises an elevation of approximately one half inch.

A concession tray 10 in accordance with the present invention may further comprise a first and second lateral edge, wherein the first lateral edge corresponds to a first lateral surface 16, and a second lateral edge corresponds to a second lateral surface 18. According to certain embodiments of the present invention, the first and second lateral surfaces 16 and 18 may be configured to enable the supporting surface 12 to collapse from a first position 50 substantially perpendicular a backrest portion 34 of a stadium seat 30 to a second position 52 substantially adjacent the backrest portion 34 of a stadium seat 30. Specifically, the first and second lateral surfaces 16 and 18 may incorporate pivoting means 20 coupled to or integral with the first and second lateral surfaces 16 and 18, and coupled to or integral with a retaining flange 22 attached to a stadium seat 30. Pivoting means 20 coupled to the first and second lateral surfaces 16 and 18 may comprise a bolt, a pin, a ball joint, or any other means known to those in the art.

A retaining flange 22 may comprise a stationary hinge, a bracket, a bolt, a pin, or any other means known to those in the art capable of operatively connecting a concession tray 10 to a backrest portion 34 of a stadium seat 30. According to certain embodiments of the present invention, the dimensions and configuration of a retaining flange 22 correspond to existing hardware used to secure the assembly of a stadium seat 30. In this manner, a retaining flange 22 may be attached to the stadium seat 30 without requiring substantial modification of the stadium seat 30, if any. In addition, a concession tray 10 in accordance with the present invention may be implemented on a large scale basis in connection with a plurality of stadium seats 30 in a performance venue while substantially limiting costs associated with materials and labor.

Figure 2:
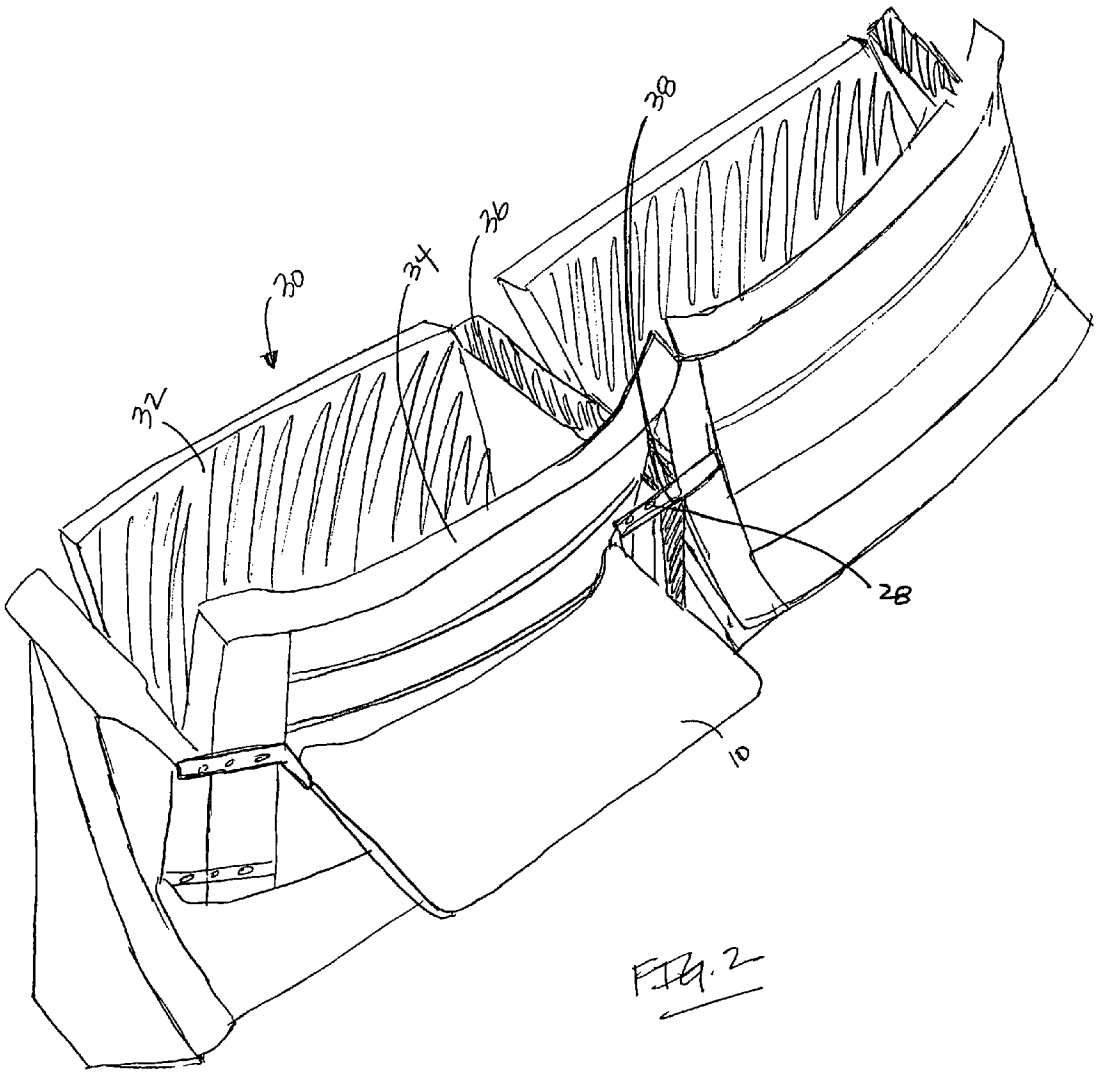
FIG. 2 is a perspective view of a stadium seat assembly in accordance with the present invention that implements the concession tray of FIG. 1A.

Referring now to FIG. 2, a stadium seat 30 may comprise a seat portion 32 and a backrest portion 34 extending in a substantially vertical direction from the seat portion 32. The backrest 34 and seat 32 portions may comprise metal, wood, fiberglass, plastic, composite, or any other durable, comfortable material known to those in the art. Typical stadium seats 30 implement a seat portion 32 which folds up, automatically or otherwise, when the seat 30 is not in use. This function maximizes space between rows of seats 30 to facilitate access to internal seats 30 via stadium aisles.

A stadium seat 30 may be supported on either side by a structural support 36 mounted to the floor or a stadium tier. A structural support 36 may be fabricated from metal, such as steel, aluminum, cast iron or any other material known to those in the art. The structural support 36 may serve a dual function in both providing a secure base for the stadium seat 30, as well as providing an independent or shared armrest between neighboring spectators. A stabilizing element 38 may be attached to a distal end of a structural support 36 and to either of two neighboring stadium seats 30 to lend stability to a side-by-side relationship between the two neighboring seats 30.

According to certain embodiments of the present invention, a retaining flange 22 may be connected to a stabilizing element 38 of a stadium seat 30 to facilitate implementation of the concession tray 10 relative to a backrest 34 of a stadium seat 30. Specifically, a retaining flange 22 may comprise an aperture 28 that corresponds to an opening 40 in the stabilizing element 38 used to receive a bolt or other hardware to fix the stabilizing element 38 against a stadium seat 30. The hardware used to secure the stabilizing element 38 against a stadium seat 30 may be adapted to also secure a retaining flange 22 against the stadium seat 30. In this manner, the concession tray 10 of the present invention may be securely implemented against the backrest portion 34 of a stadium seat 30 while minimizing costs of hardware and labor associated with such implementation.

Figure 3A:
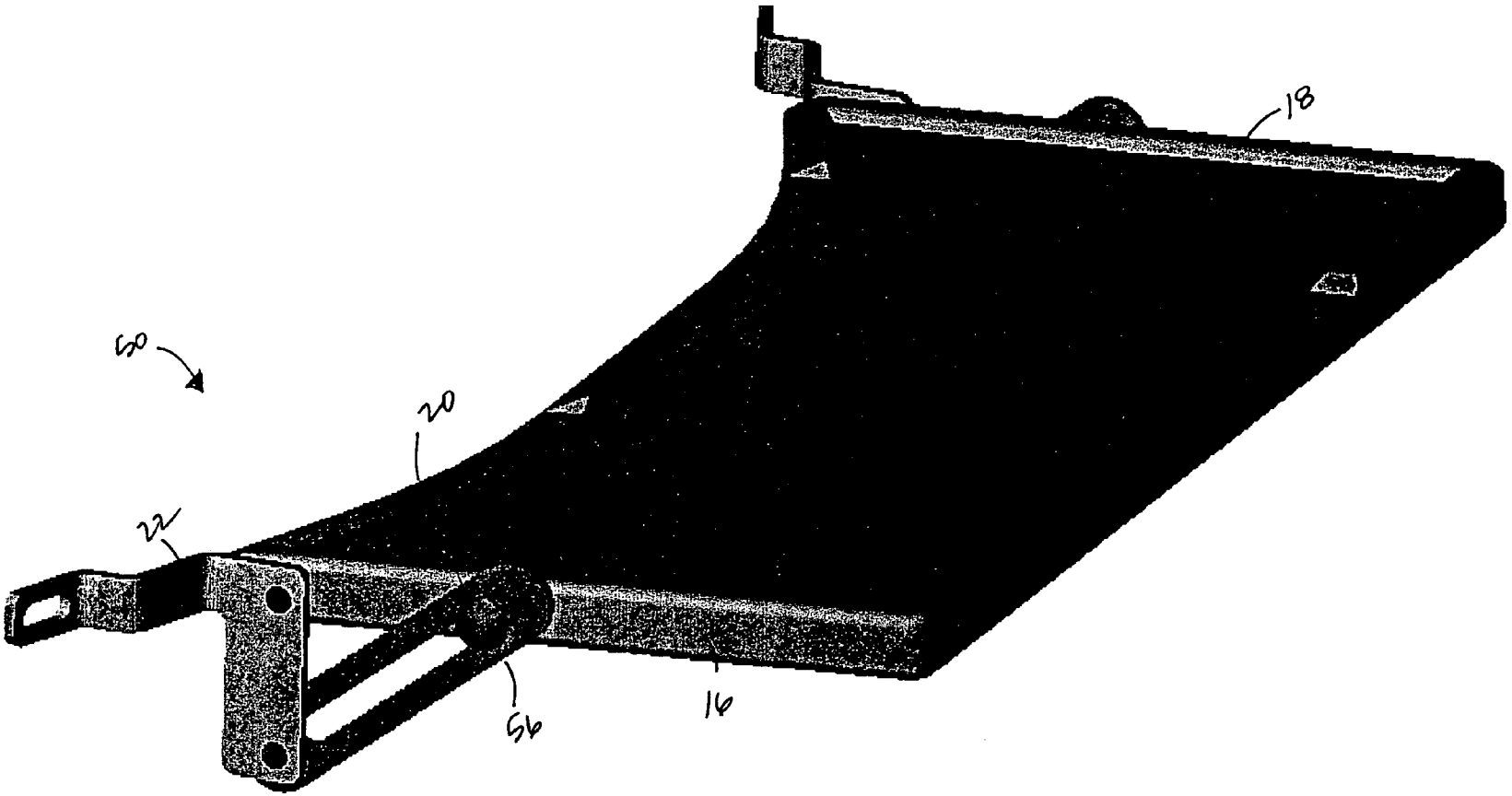
FIG. 3A is a perspective view of a concession tray in a first horizontal position in accordance with certain embodiments of the present invention.
Figure 3B:
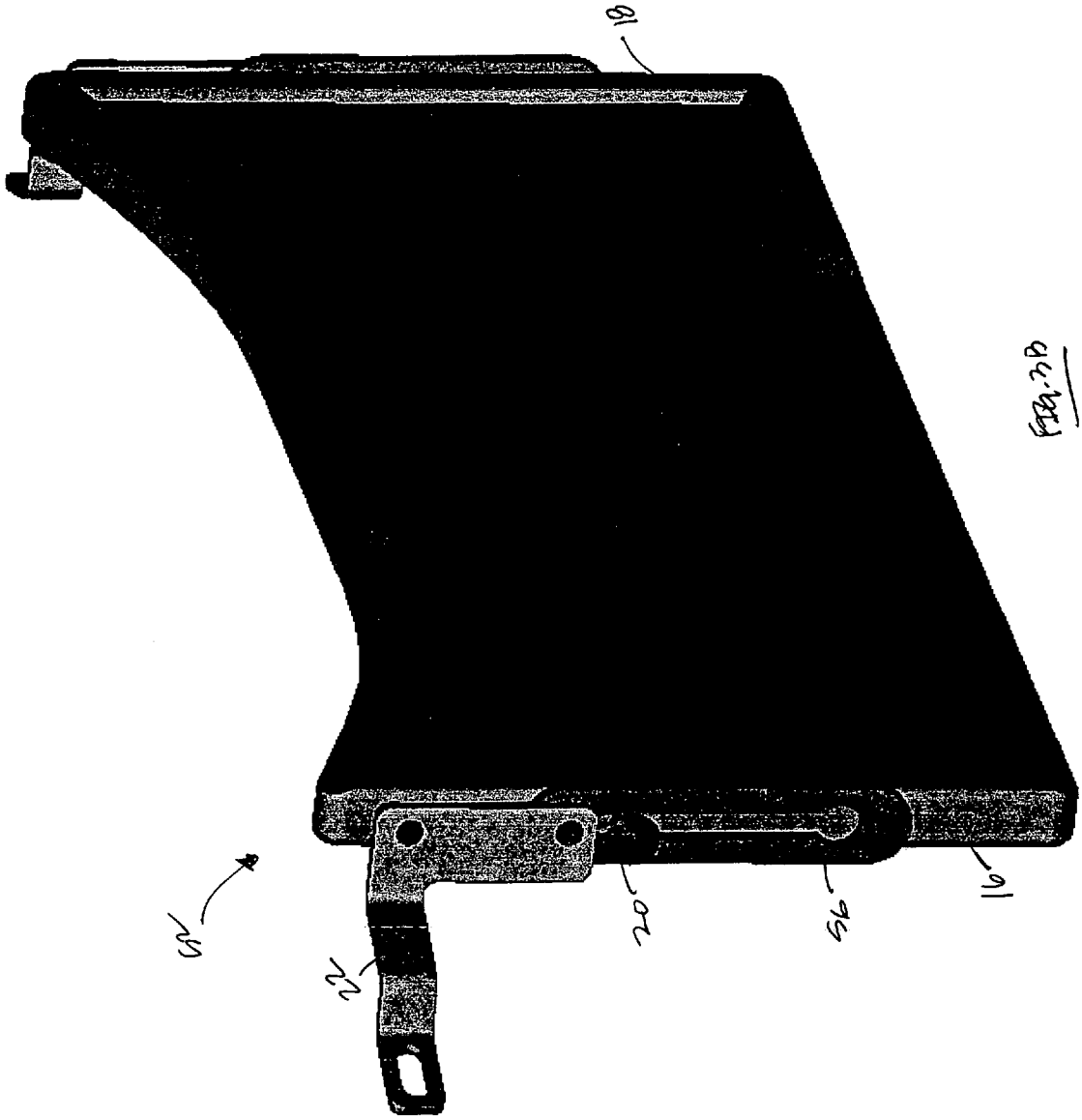
FIG. 3B is a perspective view of a concession tray in a second vertical position in accordance with certain embodiments of the present invention.
Figure 3C:
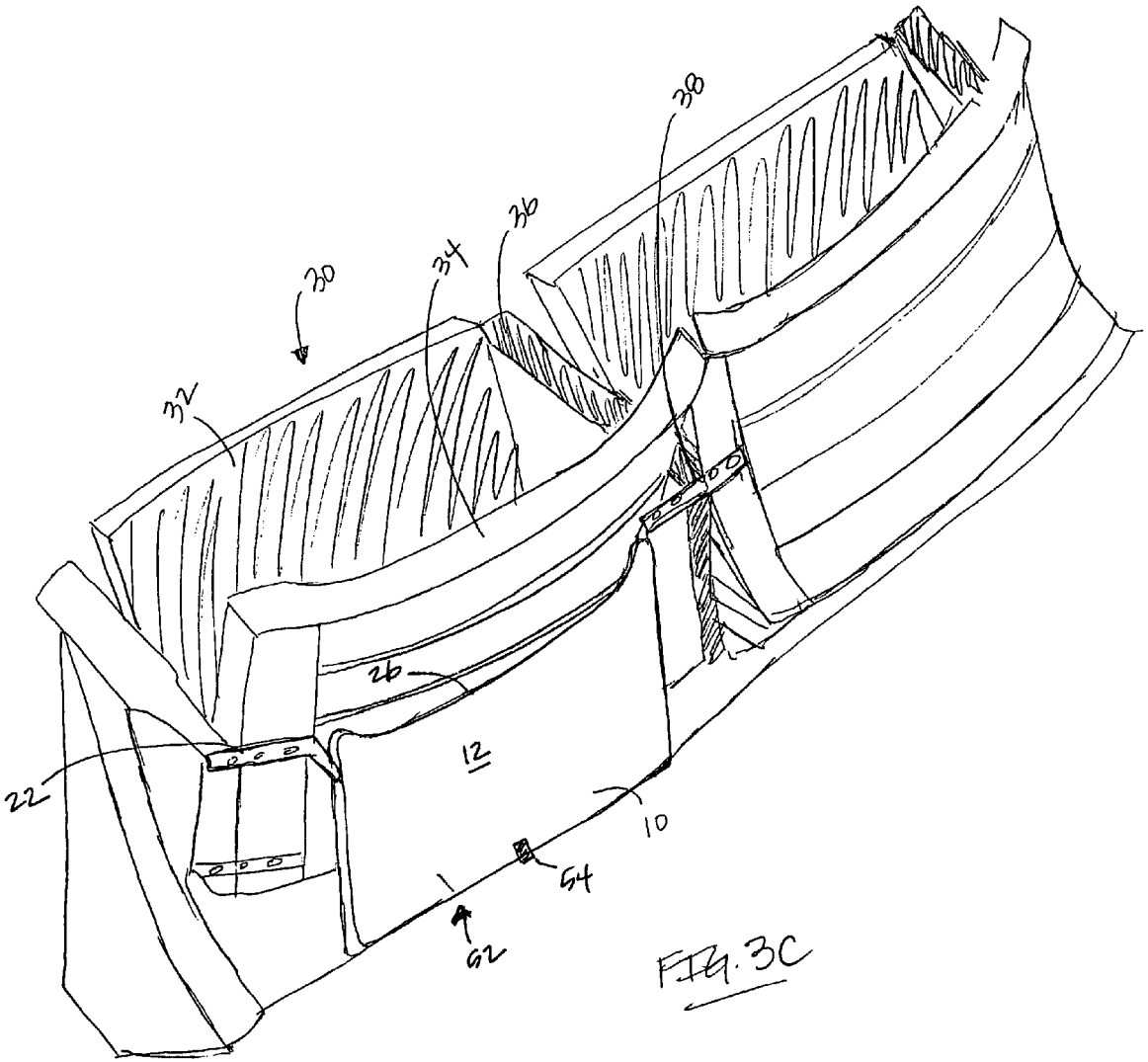
FIG. 3C is a perspective view of a concession tray stowed against the backrest of a stadium seat in accordance with certain embodiments of the present invention.

Referring now to FIGS. 3A, 3B and 3C, a concession tray 10 in accordance with the present invention may selectively pivot from a first position 50 to a second position 52. Alternatively, where a concession tray 10 is independent of a stadium seat 30, the concession tray 10 may be selectively shifted from a first position 50 to a second position 52. A first position 50 may comprise retention of the supporting surface 12 of the concession tray 10 in a substantially horizontal position relative to a backrest portion 34 of a stadium seat 30, and substantially parallel ground level. A first position 50 may further comprise a substantially adjacent relationship between a backrest portion 34 of a stadium seat 30 and a distal edge 26 of the concession tray 10. A lock element 56 may secure the concession tray 10 in its first position 50. A lock element 56 may comprise, for example, a spring, a toothed wheel, a bearing pin, or any other means known to those in the art by which to maintain a substantially perpendicular relationship between a supporting surface 12 of a concession tray 10 and a backrest 34 of a stadium seat 30. The lock element 56 may be selectively released to enable the concession tray 10 to collapse adjacent the backrest 34 to preserve space when not in use.

A second position 52 may result from collapsing the supporting surface 12 of the concession tray 10 from a first position 50 such that a supporting surface 12 of the concession tray resides substantially parallel and adjacent to a backrest portion 34 of a stadium seat 30. Alternatively, a second position 52 may comprise a substantially adjacent and parallel relationship between the back surface 14 of the concession tray 10 and the backrest portion 34 of a stadium seat 30. A turn lock 54 may be rotatably connected to the backrest portion 34 to releasably lock the concession tray 10 in its second stowed position 52.

According to one embodiment of the present invention, transition between a first position 50 and a second position 52 may be facilitated by pivoting means 20 adjoining both a lateral surface of the concession tray and a retaining flange 22 connected to a stadium seat 30. Pivoting means 20 may be coupled to either of a first lateral surface 16 or a second lateral surface 18, or may be coupled to both first and second lateral surfaces 16 and 18 for added stability. As discussed above with reference to FIG. 1, pivoting means 20 may comprise a bolt, a pin, a ball joint, or any other means known to those in the art.

According to a second embodiment of the present invention, a concession tray 10 may be independent of a stadium seat 30 such that at least one retaining flange 22 retains the concession tray 10 in a first position 50 by permitting the concession tray 10 to balance thereon in a substantially horizontal position relative to a backrest 34 of a stadium seat 30, rather than by positively securing the concession tray 10 in position. According to this embodiment, a second position 52 substantially adjacent and parallel the backrest 34 may be achieved by manually lifting the concession tray 10 from its first balanced position 50 and placing it against the backrest 34. A second position 52 may be facilitated by coupling to the backrest 34 retaining brackets configured to receive and retain the concession tray 10 in the second position 52. Alternatively, a second position 52 may comprise stowing the concession tray 10 beneath the seat portion 32 of a stadium seat 30 by sliding the concession tray 10 into retaining brackets contained on an underside thereof, by simply placing the concession tray 10 on the floor beneath the stadium seat 30, by stowing the tray 10 between stadium seats 30, or by any other means known to those in the art.

Figure 4:
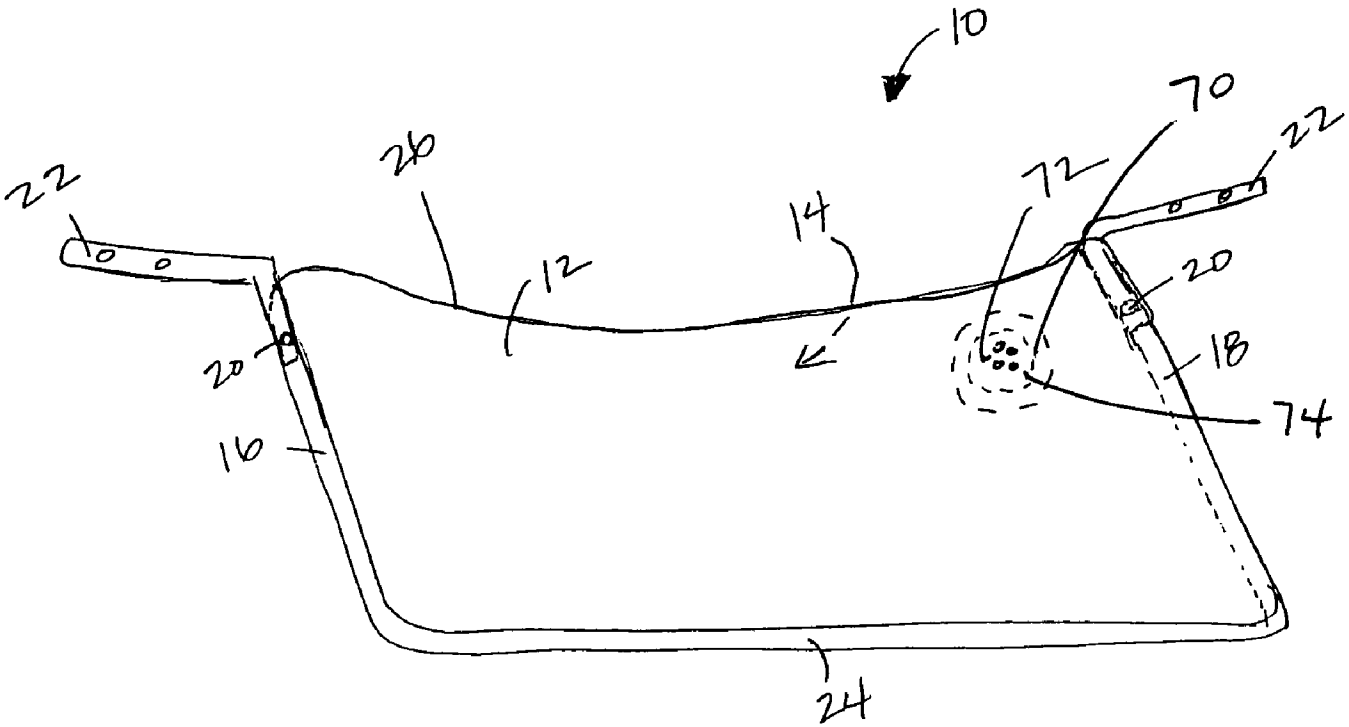
FIG. 4 is a perspective view of a second embodiment of a concession tray in accordance with the present invention.

Certain embodiments of the present invention comprise a beverage holder 70 integrated into, coupled to, or implemented proximate the concession tray 10. Referring now to FIG. 4, a beverage holder 70 may comprise a recessed portion 72 integrated into a supporting surface 12 of the concession tray. A recessed portion 72 may comprise a size and configuration appropriate to receive a standard sized beverage. For example, a recessed portion 72 may comprise a recessed circle having a diameter just larger than a standard drinking cup. Alternatively, a recessed portion 72 may comprise any shape that may function to receive and retain food and/or beverage products, such as a square, rectangle, oval, octagon, or any other appropriate shape known to those in the art. The depth of a recessed portion 72 should suffice to reduce the risk of a food or beverage product falling or tipping over, preferably within a range of two to four inches. A recessed portion 72 may further incorporate drain holes 74 to facilitate concession tray 10 cleaning.

Figure 5:
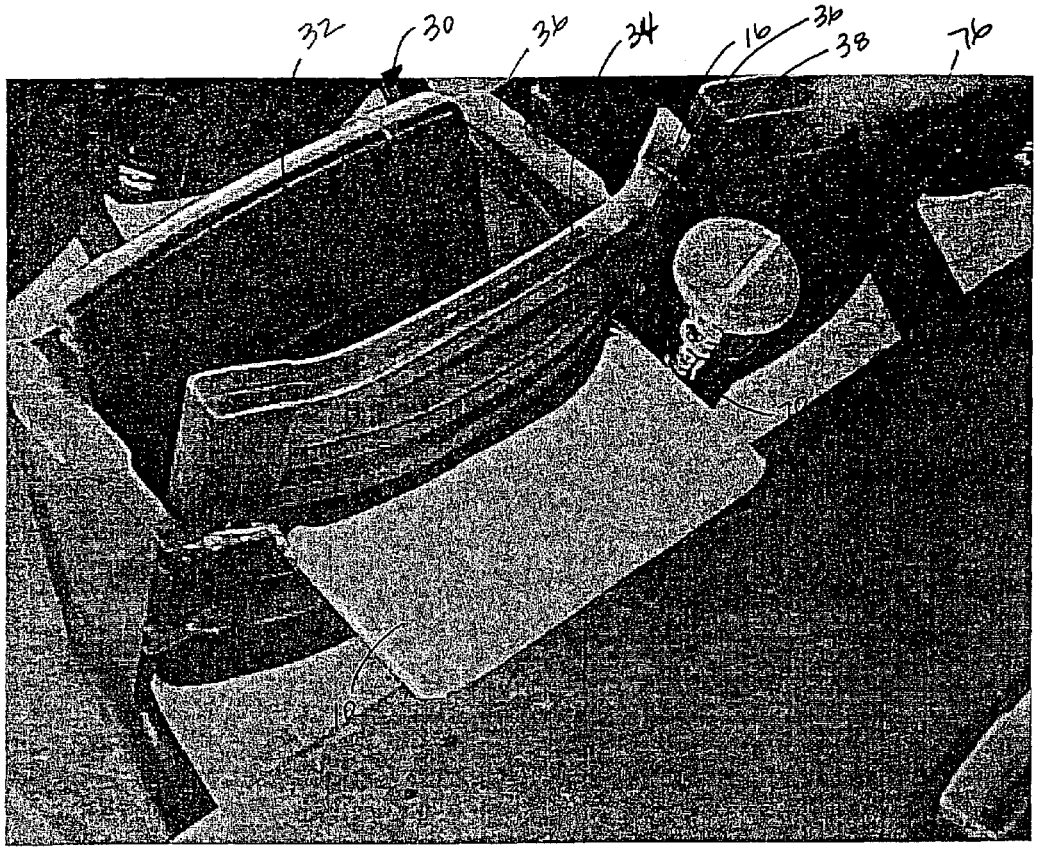
FIG. 5 is a perspective view of a third embodiment of a concession tray in accordance with the present invention.

Referring now to FIG. 5, a beverage holder 70 may comprise an independent holder receptacle 76 attached to the concession tray 10 or to a stadium seat 30. Preferably, a holder receptacle 76 is connected to a distal edge of a structural support 36 residing between neighboring stadium seats 30. In this manner, the holder receptacle 76 may be used independently of the concession tray 10 and may maintain a secure relationship with respect to a stadium seat 30. Indeed, as the structural support 36 is directly mounted to the floor or a stadium tier, it provides stable and reliable support even under tumultuous conditions. Alternatively, a holder receptacle 76 may comprise a supporting rim 78 integrated into or coupled to the concession tray 10 such that a beverage may be retained by the supporting rim 78 proximate and substantially parallel to a supporting surface 12 of the concession tray 10. One or more supporting brackets may be coupled to the supporting rim 78 to further stabilize a beverage placed therein. A holder receptacle 76 may be pivotally or slidably attached to a concession tray 10 or to a stadium seat 30 to facilitate stowing the holder receptacle 76 when the holder receptacle 76 is not in use. A holder receptacle 76 may also incorporate drain holes 74 therein to facilitate cleaning.

Figure 6:
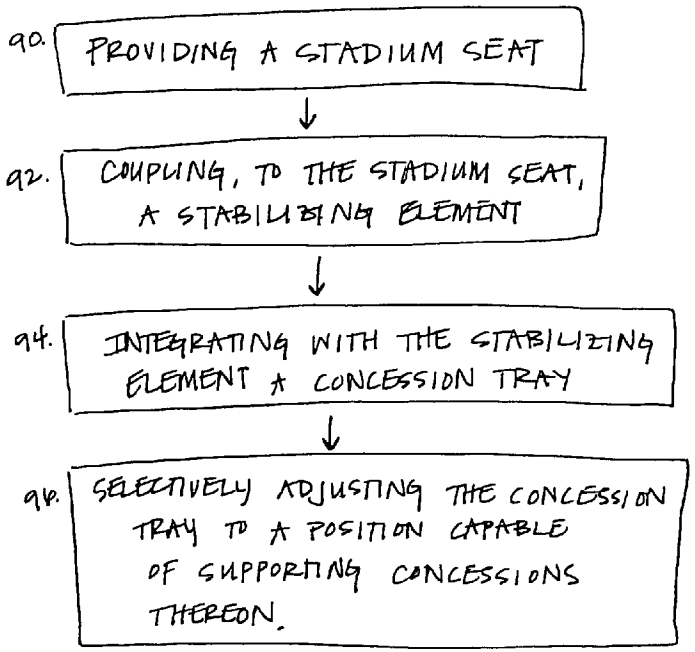
FIG. 6 is a flow chart delineating steps for providing a stadium seat assembly in accordance with the present invention.

Referring now to FIG. 6, a method for providing a stadium seat 30 assembly in accordance with the present invention may comprise first providing 90 a stadium seat 30, wherein a stadium seat 30 comprises a backrest portion 34, a seat portion 32, and a structural support portion 36. A second step of the present method may comprise coupling 92 to the structural support portion 36 a stabilizing element 38, wherein the stabilizing element 38 stabilizes a first stadium seat 30 in a side-by-side relationship with a second stadium seat 30. A third step of the present method may comprise pivotally integrating 94 with the stabilizing element 38 at least one concession tray 10, wherein the concession tray 10 may be selectively pivoted from a substantially horizontal use position to a substantially vertical stowed position. A fourth step of the present method may comprise selectively pivoting 96 the concession tray 10 to the substantially horizontal use position to support concessions thereon.

I claim:

1. A concession tray apparatus comprising:

a first seat assembly;

a second seat assembly, wherein said first and second seat assemblies face the same direction, and wherein said first seat assembly is located in front of said second seat assembly;

a supporting tray portion configured to selectively support concessions of a user of said second seat assembly, wherein said supporting tray portion comprises a top surface and a bottom surface, said top surface configured to receive one or more concessions when said tray is in a horizontal use position; and a transitional mechanism coupled to said first seat assembly and to said supporting tray portion for selectively transitioning said supporting tray portion between a vertical stowed position and said horizontal use position for a user in said second seat assembly, wherein said top surface of said supporting tray portion faces outwardly toward said second seat assembly when in said vertical stowed position, wherein at least a portion of said transitional mechanism is viewable in both said vertical stowed position and said horizontal use position, said transitional mechanism comprising:

a plurality of angled mounting brackets, each bracket comprising a first portion and a second portion, said first portion extending out horizontally from said supporting tray portion and mounted to said first seat assembly, said second portion pivotably coupled to said supporting tray portion and extending in a plane that is parallel to a side wall of said supporting tray portion, said transitional mechanism further comprising a protrusion and a channel to selectively provide a sliding orientation between said mounting brackets and said supporting tray portion, and wherein said transitional mechanism further comprises a locking mechanism to selectively retain said supporting tray portion in said horizontal use position.

2. The concession tray apparatus of claim 1, wherein said first portion is mounted to said first seat assembly using at least one of (i) a bolt, (ii) a screw, (iii) an adhesive, (iv) a rivet, (v) a nail, (vi) a clamp and (vii) a staple.

3. The concession tray apparatus of claim 1, wherein said top surface of said supporting tray portion comprises a substantially planar supporting surface having dimensions sufficient to support a plurality of concessions.

4. The concession tray apparatus of claim 3, further comprising advertising on said substantially planar supporting surface of said supporting tray portion to enable said advertising to be viewed in both said stowed position and in said use position.

5. The concession tray apparatus of claim 1, further comprising a beverage receptacle operatively connected to said supporting tray portion.

6. The concession tray apparatus of claim 5, wherein said beverage receptacle is integrally formed with said supporting tray portion.

7. The concession tray apparatus of claim 1, further comprising a beverage receptacle attached to a structural support portion of said first seat assembly and substantially adjacent said supporting tray portion.

8. The concession tray apparatus of claim 1, wherein said supporting tray portion comprises a retaining lip coupled to at least a portion of a perimeter thereof.

9. A concession tray apparatus comprising:

a supporting tray portion configured to selectively support concessions of a user when said supporting tray portion is in a horizontal use position, wherein said supporting tray portion comprises a top surface and a bottom surface; and a transitional mechanism configured to be coupled to a first seat assembly and to said supporting tray portion for selectively transitioning said supporting tray portion between a vertical stowed position, which is substantially adjacent to a backrest portion of said first seat assembly, and said horizontal use position for a user located behind said first seat assembly, wherein said top surface of said supporting tray portion faces outwardly toward said user when in said vertical stowed position, said transitional mechanism comprising:

a plurality of angled mounting brackets, wherein each bracket comprises a first portion and a second portion, said first portion extending out horizontally from said supporting tray portion and is configured to be mounted to said first seat assembly, said second portion being pivotably coupled to said supporting tray portion and extending in a plane that is parallel to a side wall of said supporting tray portion, said transitional mechanism further comprising a protrusion and a channel to selectively provide a sliding orientation between said mounting brackets and said supporting tray, and wherein said transitional mechanism further comprises a locking mechanism to selectively retain said supporting tray portion in said horizontal use position.

10. The concession tray apparatus of claim 9, wherein said supporting tray portion comprises a retaining lip coupled to at least a portion of a perimeter thereof.

11. The concession tray apparatus of claim 9, further comprising a beverage receptacle operatively connected to said supporting tray portion.

12. The concession tray apparatus of claim 11, wherein said beverage receptacle is integrally formed with said supporting tray portion.

13. The concession tray apparatus of claim 9, further comprising advertising on at least a portion of said supporting tray portion to enable said advertising to be viewable in both said stowed position and said use position.

14. The concession tray apparatus of claim 9, wherein said first and second portions of said mounting bracket form an obtuse angle.

15. A concession tray apparatus comprising:

a supporting tray portion configured to be able to be selectively transitioned between a horizontal use position and a vertical stowed position, wherein said supporting tray portion is configured to selectively support concessions of a user when said supporting tray portion is in said horizontal use position, and wherein said supporting tray portion comprises a top surface, a bottom surface, and a plurality of side walls; and a transitional mechanism configured to be coupled to a first seat assembly and to said supporting tray portion for selectively transitioning said supporting tray portion between said vertical stowed position and said horizontal use position for a user positioned behind said first seat assembly, wherein said top surface of said supporting tray portion faces outwardly away from said first seat assembly when in said vertical stowed position, said transitional mechanism comprising:

an obtusely angled mounting bracket comprising a first portion and a second portion, said first portion extending out horizontally from said supporting tray portion and configured to be mounted to said first seat assembly, said second portion pivotably coupled to said supporting tray portion and extending in a plane that is parallel to one of said side walls of said supporting tray portion, said transitional mechanism further comprising a protrusion and a channel to selectively provide a sliding orientation between said mounting bracket and said supporting tray portion, and wherein said transitional mechanism further comprises a locking mechanism to selectively retain said supporting tray portion in said horiztontal use position.

16. The concession tray apparatus of claim 15, further comprising advertising on at least a portion of said top surface of said supporting tray portion to enable said advertising to be viewable in both said stowed position and said use position.

* * * * *